United States Patent [19]

Lasley

[11] Patent Number: 4,911,367

[45] Date of Patent: Mar. 27, 1990

[54] ELECTROSTATIC SPRAY GUN

[75] Inventor: Charles T. Lasley, Toledo, Ohio

[73] Assignee: The DeVilbiss Company, Toledo, Ohio

[21] Appl. No.: 330,153

[22] Filed: Mar. 29, 1989

[51] Int. Cl.[4] ..... B05B 5/00

[52] U.S. Cl. ..... 239/691; 239/707; 361/227; 361/228; 439/840

[58] Field of Search ..... 239/690, 691, 704–708; 361/227, 228; 439/840, 841, 13, 21, 26

[56] References Cited

U.S. PATENT DOCUMENTS

| | | | |
|---|---|---|---|
| 3,077,523 | 2/1963 | Clewes | 439/668 X |
| 4,335,851 | 6/1982 | Hastings | 239/3 |
| 4,598,871 | 7/1986 | Hartle | 239/706 |
| 4,721,255 | 1/1988 | Lind | 239/690 |

*Primary Examiner*—Andres Kashnikow
*Assistant Examiner*—William Grant
*Attorney, Agent, or Firm*—MacMillan, Sobanski & Todd

[57] ABSTRACT

A continuous electrical connection between a high voltage power source and a paint charging electrode in an electrostatic spray gun. The electrode is mounted on a valve needle which is reciprocated by a trigger mechanism as the spray gun is operated. A novel spring establishes and maintains the electrical connection from a stationary contact on the gun barrel to the moving valve needle. The spring may be mounted on a spacer tube mounted coaxially about the valve needle. The spacer tube can move in an axial direction to exert a force on a seal between the barrel and the valve needle without affecting the electrical connection.

8 Claims, 3 Drawing Sheets

ELECTROSTATIC SPRAY GUN

TECHNICAL FIELD

The invention relates to spray painting and more particular to an improved electrical connection to a paint charging electrode which is mounted on a reciprocated needle valve in an electrostatic paint spray gun.

BACKGROUND ART

In manual or hand held electrostatic paint spray guns, a manually operated trigger moves a valve needle in a linear direction to open a paint valve for initiating spraying. In one common type of spray gun, an electrode projects from the end of the valve needle through a paint discharge orifice. The electrode is connected to a high voltage power supply for imparting an electrostatic charge to the paint as it is atomized. The electrode may be, for example, maintained at from 20,000 to 80,000 volts dc, or more, relative to the grounded workpiece which is being painted. In an automatic spray gun used for larger scale production, the manual trigger is replaced with an automatic trigger mechanism which reciprocates the valve needle in a linear direction in response to, for example, an electric signal or a pneumatic signal.

In either type of electrostatic spray gun, it is necessary to maintain a continuous electrical connection between the power source and the paint charging electrode as the electrode and the supporting valve needle are reciprocated by the trigger mechanism. In U.S. Pat. No. 4,335,851 to Hastings, a spray gun is shown in which a pin extends perpendicularly through and projects from opposite sides of an electrically insulated valve needle. The paint charging electrode which projects from the front of the valve needle is electrically connected to the pin. A wire is embedded in the electrically non-conducting spray gun barrel to connect a high voltage source to a step in a bore through the barrel in which the valve needle is reciprocated. A spring is compressed between the end of the wire at the step and the pin through the valve needle to establish electrical contact between the wire and the electrode as the valve needle is reciprocated. In U.S. Pat. No. 4,721,255 to Lind, the paint charging electrode projects from the front of the valve needle and also projects from the side of the valve needle and extends along the side of the valve needle parallel to the axis of the valve needle. The portion extending parallel to the side of the valve needle presses against a fixed contact mounted in the gun barrel. The fixed contact is connected to the high voltage power source to maintain an electrical connection as the valve needle is reciprocated.

DISCLOSURE OF INVENTION

The invention is directed to an improved electrical connection to a paint charging electrode which is mounted on a needle valve in an electrostatic paint spray gun. The valve needle and the electrode are reciprocated as the spray gun is turned on and off. High voltage is applied from a source to a wire embedded in an electrically insulating spray gun barrel. The wire leads to a bore through the barrel in which the valve needle is mounted to reciprocate. The wire terminates on a step in the barrel bore. The valve needle includes an electrically conductive stem which is electrically connected to the paint charging electrode. An insulated spacer tube surrounding a portion of the valve stem is spring biased in a forward direction to compress a radial fluid seal between the barrel and the reciprocated valve needle to prevent liquid from leaking between the barrel and the valve needle.

According to the invention, a novel spring establishes electrical contact between the wire connected to the power source and the conductive valve stem. The spring permits the valve needle to reciprocate without interruption of the electrical connection or of the force exerted by the spacer tube on the seal. The spring is mounted on the tube which also is capable of sliding in an axial direction to maintain pressure on the fluid seal. The spring has a larger diameter forward end loop which presses against the barrel bore step and the high voltage wire embedded in the barrel. A smaller diameter rear end loop on the spring is seated against a step on the spacer tube. From the rear end loop, the spring extends in a forward direction along a side of the spacer tube, through a radial hole in the side of the spacer tube and radially inwardly. The spring has a free end which terminates at a location past the axis of the spacer tube. This end is deflected sideways by and presses against the side of the valve stem to maintain contact with the valve stem as the valve stem and/or the spacer tube move in an axial direction to maintain a continuous electrical contact between the spring and the valve stem.

Accordingly, it is an object of the invention to provide an improved electrical connection between a source of high voltage and an electrode mounted on a reciprocated valve needle in an electrostatic spray gun.

Other objects and advantages of the invention will become apparent from the following detailed description, with reference to the accompanying drawings.

BEST MODE FOR CARRYING OUT THE INVENTION

Figure 1:
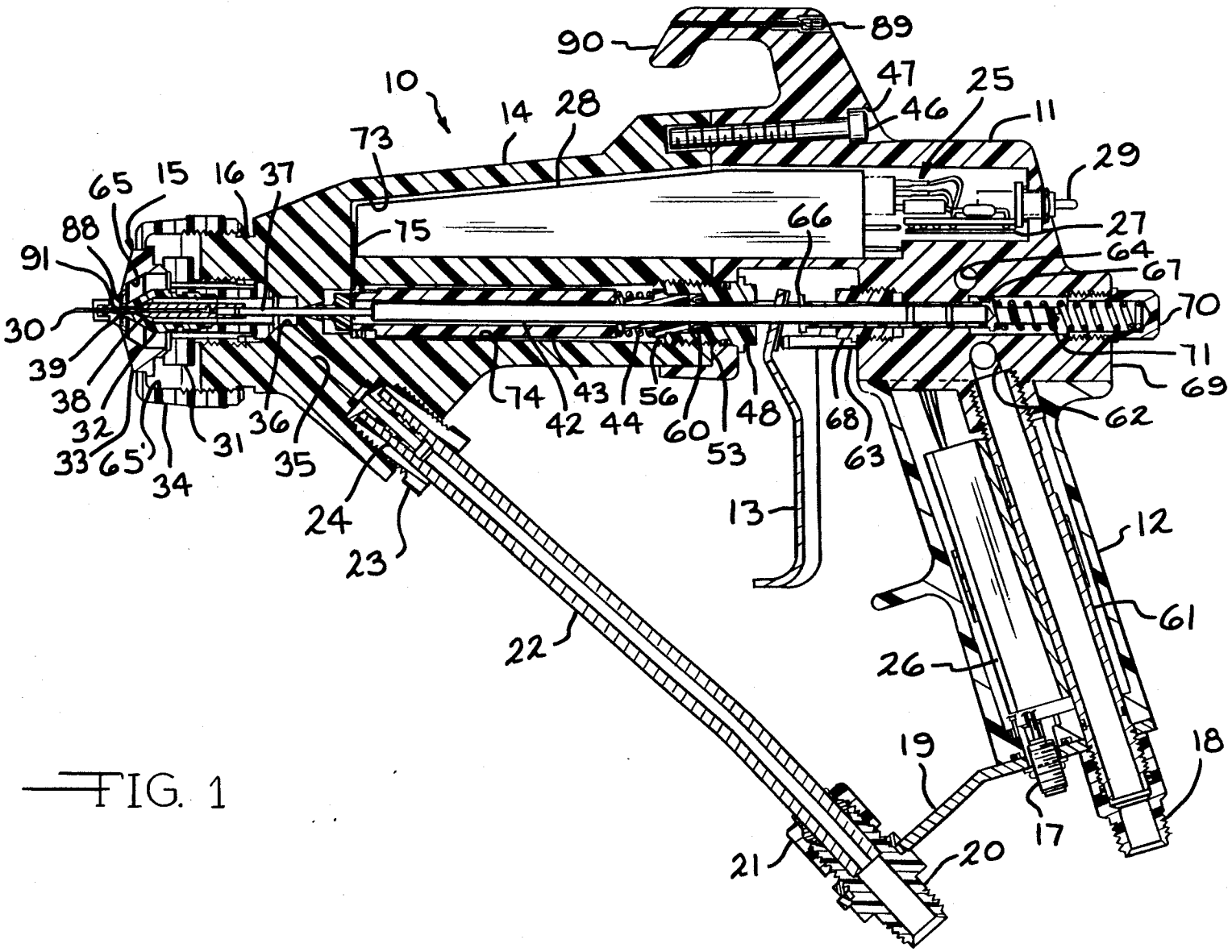
FIG. 1 is a cross sectional view through a hand held electrostatic spray gun embodying a preferred embodiment of the invention.

Referring to FIG. 1 of the drawings, a spray gun 10 embodying the invention is shown in cross section. The spray gun 10 generally includes a body 11 having a handle 12, a trigger 13 and a barrel 14 attached thereto. A nozzle assembly 15 is attached to an end 16 of the barrel 14. At the lower end of the gun handle 12, a connector 17 receives electrical power from a suitable external power source (not shown) and compressed air is applied to a fitting 18 from a suitable source (not shown). A bracket 19 attached to the handle 12 supports a fluid fitting 20 and one end 21 of a tube 22. An adapter 23 is threaded into the barrel 14 to attach the other end 24 of the tube 22 to the barrel 14. A coating material supply hose (not shown) is attached to the fluid fitting 20 for supplying paint or other coating material through the tube 22 to the barrel 14. The tube 22 and the bracket 19 place the connection to the coating material supply hose closer to the handle 12 to provide better balance to the gun 10 and also to eliminate strain from the relatively heavy material supply hose from the barrel 14.

The electrical connector 17 receives a low voltage direct current for driving an internal high voltage power supply 25. In the illustrated spray gun 10, the high voltage power supply 25 comprises an oscillator module 26, a switching module 27 and a voltage multiplier module 28. The oscillator module 26 converts the low voltage direct current to an alternating current. The switching module 27 turns the oscillator module 26 on and off under the control of a manual switch 29. The switching module 27 limits the voltage and the current available at the switch to a sufficiently low level to prevent arcing which could ignite flammable paint solvent fumes. The alternating current output from the oscillator module 26 is applied to a voltage step-up transformer (not shown) either in the oscillator module 26 or in the voltage multiplier module 28 to produce an intermediate voltage alternating current. The intermediate voltage alternating current is rectified and multiplied in the voltage multiplier module 28 to a very high voltage direct current, for example between 20,000 and 80,000 volts dc. As will be described in greater detail below, the high voltage output from the voltage multiplier module 28 is applied to an electrode 30 which projects from the nozzle 15. In a modified embodiment of the spray gun 10, the internal power supply 25 can be replaced with an external power supply (not shown) which is connected through a high voltage cable and a large series resistor through the spray gun handle 12, the body 11 and the barrel 14 and thence to the electrode 30.

Figure 6:
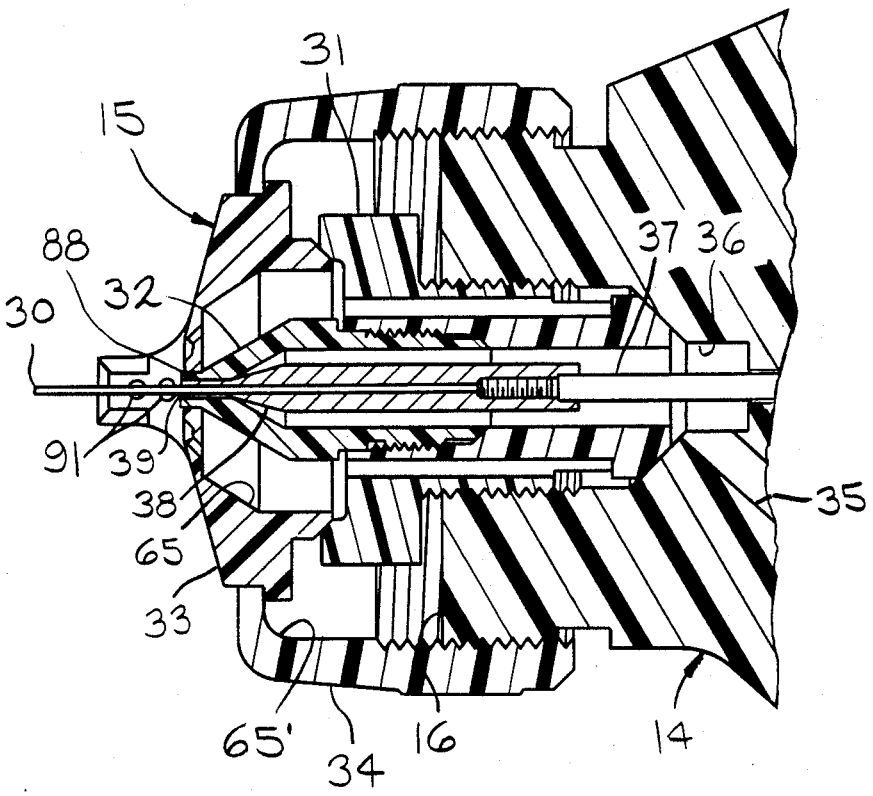
FIG. 6 is an enlarged fragmentary cross sectional view of the nozzle assembly for the spray gun of FIG. 1.

As shown in FIGS. 1 and 6, the nozzle assembly 15 includes a fluid nozzle 31 which is threaded into the barrel 14, a fluid tip 32 which is threaded into the fluid nozzle 31, an air cap 33 which is positioned over the fluid tip 32 and the fluid nozzle 31, and a retainer ring 34 which is threaded on the barrel end 16 to retain the air cap 33 on the barrel 14. Paint received from the fitting 20 and the tube 22 flows through a passage 35 in the barrel 14 to a chamber 36 formed between the barrel 14, the fluid nozzle 31 and the fluid tip 32. A valve stem 37 extends into the chamber 36 and supports a valve head 38 which normally is seated against the fluid tip 32 to block a fluid discharge orifice 39. The valve head 38 is threaded onto the valve stem 37 to permit replacement of the valve head 38. The electrode 30 is mounted in the valve head 38 and extends in an axial direction through the valve head 38 to, at one end, project through the orifice 39 and, at the opposite end, to electrically connect with the valve stem 37. If desired for safety reasons, a resistor (not shown) may be located in the valve head 38 electrically in series between the electrode 30 and the valve stem 37.

Figure 2:
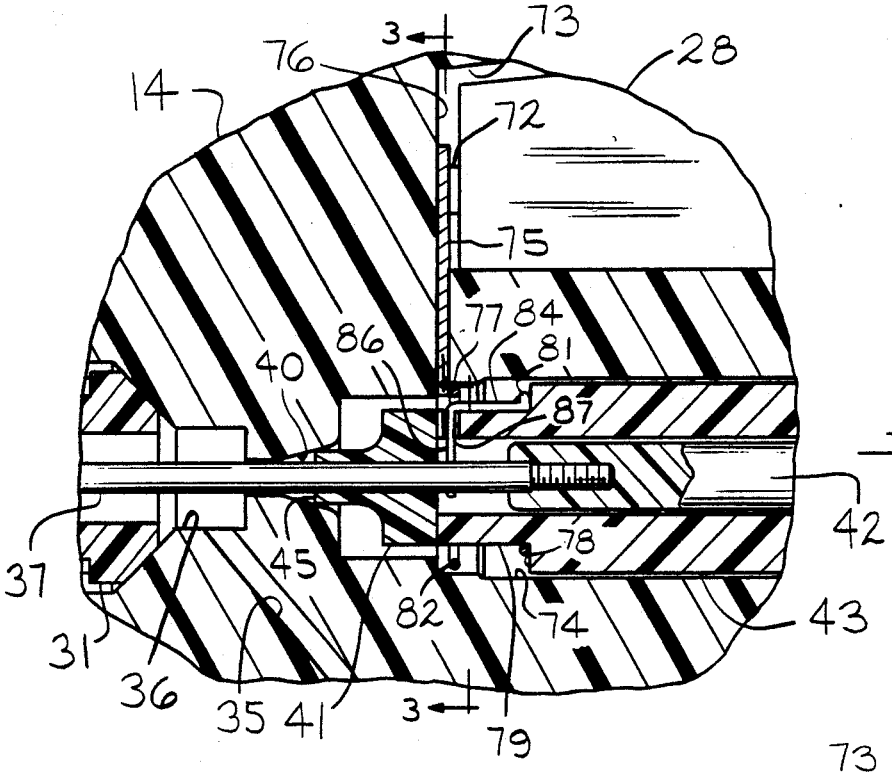
FIG. 2 is an enlarged fragmentary cross sectional view of a portion of the spray gun of FIG. 1 showing details for the electrical connection from the high voltage power supply to the trigger actuated valve needle.

As best seen in FIG. 2, the valve stem 37 extends in a rearward direction through a tapered hole 40 in the barrel and through a seal 41 and is attached to an electrically non-conducting actuator rod 42. A spacer tube 43 surrounding the actuator rod 42 is biased in a forward direction by a spring 44 (FIGS. 1 and 5) to press an annular front edge 45 on the seal 41 against the tapered hole 40 and thus form a radial fluid seal between the barrel 14 and the valve stem 37. The seal 41 is effective to prevent leakage from the chamber 36 even when high pressure paint is present in the chamber 36 and the valve stem 37 is reciprocated. Further details on the seal 41 are shown in U.S. Pat. No. 4,406,468.

Figure 5:
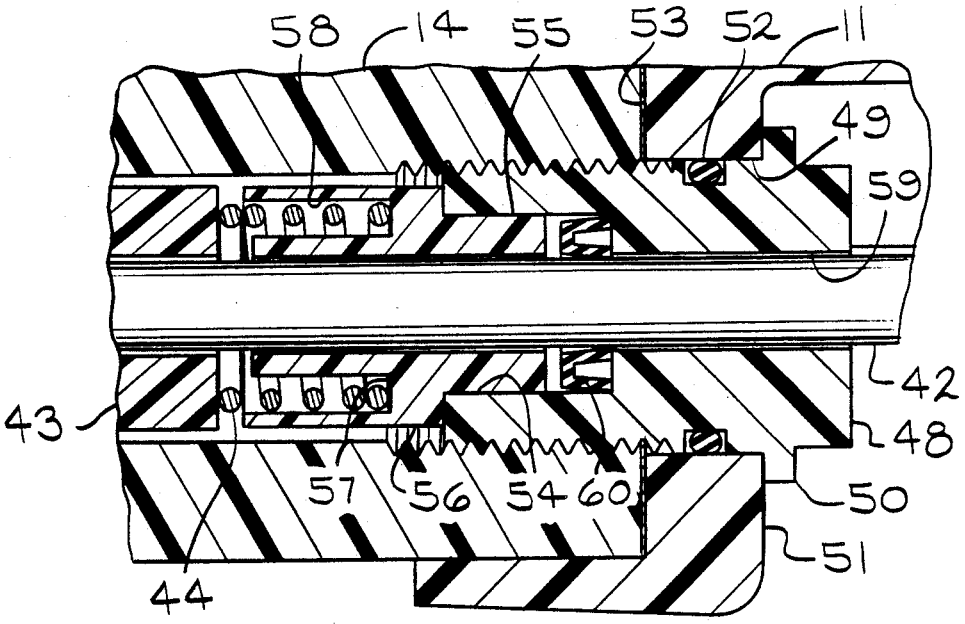
FIG. 5 is an enlarged fragmentary cross sectional view of a portion of the spray gun of FIG. 1 showing details of the seal where the valve needle enters the gun body and of the retainer which connects the gun barrel to the gun body.

The barrel 14 is attached to the body 11 at two points, as shown in FIGS. 1 and 5. A bolt or cap screw 46 inserted into a stepped opening 47 adjacent the top of the body 11 is threaded into the top of the barrel 14. A retainer 48 connects the bottom of the body 11 to the barrel 14. The retainer 48 serves several functions. The retainer is passed through an opening 49 through the body 11 and threaded into the barrel 14 until a shoulder 50 on the retainer 48 abuts a wall 51 on the body 11. An O-ring seal 52 is located between the retainer 48 and the body 11 and a gasket 53 is located between the barrel 14 and the body 11. The seal 52 and the gasket 53 prevent liquid leakage between the retainer 48, the body 11 and the barrel 14. For additional protection against leakage, an O-ring seal (not shown) also may be located at the joint between the retainer 48, the body 11 and the barrel 14.

The retainer 48 has a stepped axial opening 54. A reduced diameter end 55 of a seat 56 is telescoped into the end of the retainer opening 54 interior to the barrel 14. The seat 56 has an annular opening 58 terminating at a bottom 57. The spring 44 is positioned coaxially in the annular opening 58 to compress between the opening bottom 57 and the spacer tube 43. The exterior wall of the opening 58 prevents the spring 44 from significantly reducing the voltage breakdown path between the high voltage valve stem 37 and the grounded electrically conductive body 11. The valve actuator rod 42 extends coaxially through the spacer tube 43, the seat 56 and the retainer 48. A portion 59 of the retainer opening 54 is sized to serve as a guide for the actuator rod 42 adjacent the body wall 51. A radial seal 60 is located in the retainer opening 54 between the retainer 48 and the seat 56 to form a fluid seal between the retainer 48 and the actuator rod 42 which permits the actuator rod 42 to slide in an axial direction.

As shown in FIG. 1, the air fitting 18 on the handle 12 is attached to a tube 61 which extends through the handle 12 and is threaded into a passage 62 in the body 11. The tube 61 and the fitting 18 retain the handle 12 on the body 11. The trigger 13 is mounted on the body 11 to pivot as it is squeezed. As the trigger 13 is squeezed, an air valve actuator 63 is pushed to open an air valve (not shown) to connect the passage 62 to a passage 64. The passage 64 is connected through passages (not shown) in the body 11 and the barrel 14 to chambers 65 and 65, in the nozzle assembly 15 between the barrel 14, the fluid nozzle 31, the fluid tip 32, the air cap 33 and the retainer ring 34.

As the trigger 13 is further squeezed, it engages a plunger 66 which is retained on the actuator rod 42. The plunger 66 is supported and guided for axial movement in an opening 67 through the body 11 by a bushing 68. At the rear 69 of the body 11, a spring retainer cap 70 is threaded into the opening 67. A return spring 71 is positioned between the retainer cap 70 and the plunger 66. When the trigger 13 is released, the spring 71 moves the plunger 66 and the attached actuator rod 42 forward to seat the valve head 38 against the fluid tip 32 and interrupt the flow of paint.

To prevent grounding of the high voltage the barrel 14 is made from an electrically non-conducting synthetic resinous material. For safety reasons, the body 11 and the handle 12 are made from an electrically conducting synthetic resinous material. It is necessary to maintain a direct electrical connection between the high voltage output at a terminal 72 (FIG. 2) on the high voltage module 28 and the electrode 30 as the actuator rod 42 is moved by the trigger 13 to open the fluid valve. Referring to FIGS. 1–4, details are shown for the electrical connection. The high voltage module 28 is located in a chamber 73 which extends between the barrel 14 and the body 11. In the barrel 14, the actuator rod 42, a portion of the valve stem 37 and the spacer tube 43 are located in a stepped bore 74 extending through the barrel 14. An electrical conductor wire 75 is embedded in the electrically insulating barrel 14 to extend from a front end 76 of the chamber 73 to a step 77 in the bore 74. When the high voltage module 28 is located in the chamber 73, the high voltage terminal 72 contacts the wire 75.

Figure 4:
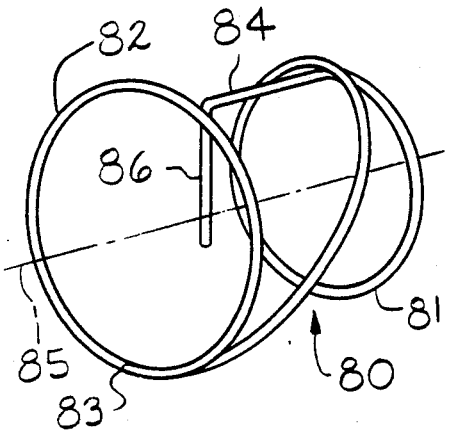
FIG. 4 is an enlarged perspective view of the spring which establishes a sliding electrical contact with the trigger actuated valve needle.

The spacer tube 43 has a radial step 78 and a reduced diameter end 79 adjacent the seal 41. A contact spring 80 establishes a continuous electrical connection between the wire 75 and the metal valve stem 37 as the valve stem 37 is reciprocated in an axial direction by the trigger 13 and as the spacer tube 43 moves in an axial direction to exert pressure on the seal 41. As best seen in FIG. 4, the spring 80 is in the general form of a modified helix extending between a first or rear end loop 81 and a second or forward end loop 82. The second or forward end loop 82 is slightly larger in diameter than the first end loop 81. The spring 80 has an end 83 terminating at the second loop. From the rear end loop 81, the spring 80 has a side 84 extending forward in a direction parallel to the axis 85 of the spring 80. From the side 84, the spring 80 has a side 86 extending radially inwardly past the axis 85. The smaller rear end loop 81 on the spring 80 is sized to engage and retain the spring 80 on the spacer tube end 79 with the loop abutting the tube step 78. When the rear end loop 81 is positioned on the spacer tube 43, the spring side 84 extends forward along the tube end 79 and the spring side 86 projects radially inwardly through a radial hole 87 through the tube end 79.

Figure 3:
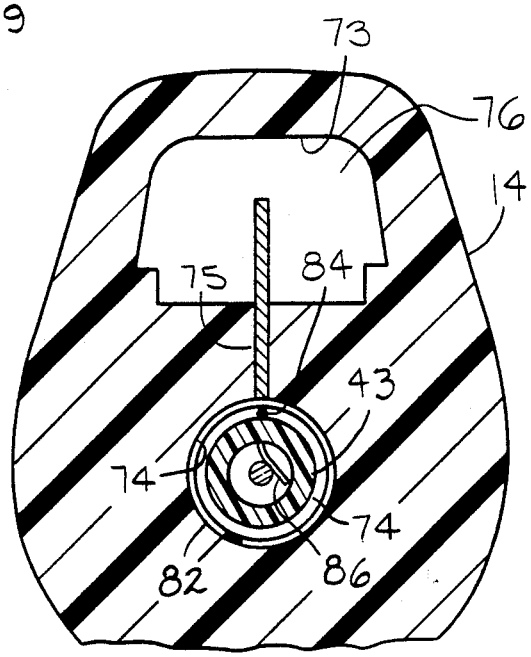
FIG. 3 is a cross sectional view taken along line 3—3 of FIG. 2.

The enlarged diameter forward loop 82 on the spring 80 presses against the wire 75 at the step 77 in the barrel bore 74 to establish an electrical connection between the spring 80 and the high voltage power supply terminal 72. At the same time, the radially directed spring side 86 is deflected to one side by and presses against the valve stem 37, as shown in FIG. 3. Thus, a good electrical connection is established between the wire 75 and the valve stem 37 regardless of the rotational position of the spring 80 and the spacer tube 43 and regardless of the axial position of the valve stem 37. Since the electrode 30 extends through the valve head 38 and contacts the valve stem 37, a continuous electrical connection is maintained between the output contact 72 of the high voltage module 28 and the electrode 30.

After compressed air is applied to the fitting 18, power is applied to the connector 17 and paint or other coating material is supplied to the fitting 20, the spray gun is operated by turning on the switch 29 to turn on the high voltage power supply 25 and squeezing the trigger 13. Optionally, a neon glow tube 89 may be mounted in a gun hanger 90 which is integral with the body 11. When the high voltage is turned on, the electrostatic field surrounding the gun 10 is sufficient to cause the tube 89 to glow to inform the operator that the power supply is on and properly operating. As the trigger is progressively squeezed, atomization air is applied to the nozzle chamber 65 and, if a fan shaped spray pattern is desired, pattern shaping air is applied to the chamber 65'. A separate valve (not shown) may be provided in the gun body 11 to adjust or to totally interrupt the delivery of pattern shaping air to the chamber 65' when the trigger 13 is squeezed. The atomization air flows from the chamber 65 through an annular orifice 88 which is located between the fluid tip 32 and the air cap 33 and surrounds the paint discharge orifice 39. Further movement of the trigger 13 causes the actuator rod 42 to move to separate the valve head 38 from its seat against the fluid tip 32, allowing paint to flow from the orifice 39. As the paint is discharged from the orifice, it is atomized by air discharged from the orifice 88 to form a round expanding pattern and it is charged by the high voltage electrode 30. If a fan shaped pattern is desired, air is delivered to the chamber 65' and discharged from orifices 91 on diametrically opposite sides of the orifice 39 to shape the pattern of the atomized paint.

It will be appreciated that various modifications and changes may be made in the above described preferred embodiment of the spray gun 10 without departing from the spirit and the scope of the following claims.

I claim:

1. In an electrostatic spray gun including an electrically insulating barrel, a power source connected to a contact on a step in a stepped bore through said barrel, a valve needle assembly mounted to reciprocate in an axial direction in said stepped bore, said valve needle assembly including an electrically conductive valve stem and means electrically connecting said valve stem to a paint charging electrode projecting from an end of the valve needle assembly, an improved electrical connection between said contact and said valve stem comprising a generally helical spring, means mounting said spring generally coaxially in said stepped barrel bore, said spring having a first loop compressed against said barrel bore step and in electrical contact with said contact, said spring having a free end tending to extend radially inwardly towards said axis and deflected by said valve stem, said free end establishing a continuous electrical contact between said spring and said valve stem as said valve stem is reciprocated.

2. An improved electrical connection in an electrostatic spray gun, as set forth in claim 1, wherein said means mounting said spring includes a tube mounted to extend coaxially around a portion of said valve needle assembly, said tube having a radial step at a reduced diameter end, said spring having a second loop positioned on said reduced diameter end and abutting said tube step.

3. An improved electrical connection in an electrostatic spray gun, as set forth in claim 2, wherein said tube has a radially directed opening extending through said reduced diameter end, and wherein said free end of said spring extends through said tube opening.

4. An improved electrical connection in an electrostatic spray gun, as set forth in claim 3, and wherein said tube is mounted to move in an axial direction in said barrel bore.

5. An improved electrical connection in an electrostatic spray gun, as set forth in claim 4, and further including a radial fluid seal between said valve stem and said barrel, and means urging said tube in an axial direction to press against said fluid seal.

6. An improved electrical connection in an electrostatic spray gun, as set forth in claim 2, wherein said second spring loop has a smaller diameter than said first spring loop.

7. An improved electrical connection in an electrostatic spray gun, as set forth in claim 2, and further including spring means urging said spacer tube in an axial direction tending to move said radial step on said spacer tube toward said barrel bore step.

8. An improved electrical connection in an electrostatic spray gun, as set forth in claim 7, and further including a radial seal between said barrel and said valve stem, and wherein said spring means biases said reduced diameter end of said spacer tube against said radial seal.

* * * * *